US009187237B1

(12) United States Patent
Pedotto, Jr.

(10) Patent No.: US 9,187,237 B1
(45) Date of Patent: Nov. 17, 2015

(54) BUTANE LIGHTER AND WICK

(76) Inventor: Jack A. Pedotto, Jr., Denver, CO (US)

( * ) Notice: Subject to any disclaimer, the term of this patent is extended or adjusted under 35 U.S.C. 154(b) by 498 days.

(21) Appl. No.: 13/176,462

(22) Filed: Jul. 5, 2011

Related U.S. Application Data

(60) Provisional application No. 61/361,153, filed on Jul. 2, 2010.

(51) Int. Cl.
*F23Q 2/44* (2006.01)
*B65D 85/672* (2006.01)

(52) U.S. Cl.
CPC ..... *B65D 85/672* (2013.01)

(58) Field of Classification Search
USPC ..... 206/408, 409, 85, 86, 87, 88, 89, 216, 206/38; 431/143, 276, 317, 255, 120, 315, 431/316, 318, 325, 345, 356; 131/329, 330, 131/178
See application file for complete search history.

(56) References Cited

U.S. PATENT DOCUMENTS

| | | | | | |
|---|---|---|---|---|---|
| 1,234,580 | A * | 7/1917 | Stimpson | 206/89 |
| 1,802,489 | A * | 4/1931 | Wilt et al. | 206/88 |
| 1,851,057 | A * | 3/1932 | Picker | 206/89 |
| 1,963,345 | A * | 6/1934 | Zwilling | 431/255 |
| 2,559,303 | A * | 7/1951 | Lowenthal et al. | 206/88 |
| 2,741,109 | A * | 4/1956 | Dupuis | 431/319 |
| 2,753,705 | A * | 7/1956 | Quartier | 431/316 |
| 2,945,583 | A * | 7/1960 | Sire | 206/1.5 |
| 3,711,240 | A * | 1/1973 | Warshaw | 431/253 |
| 4,026,063 | A * | 5/1977 | Allen et al. | 43/54.1 |
| 4,410,084 | A * | 10/1983 | Ladner | 206/53 |
| 4,606,134 | A * | 8/1986 | Flick | 33/414 |
| 4,774,032 | A * | 9/1988 | Coates et al. | 261/104 |
| 4,790,225 | A * | 12/1988 | Moody et al. | 83/100 |
| 4,852,729 | A * | 8/1989 | Conte | 206/86 |
| 5,353,827 | A * | 10/1994 | Bouchard et al. | 137/1 |
| 5,378,301 | A * | 1/1995 | Boreali et al. | 156/719 |
| 6,223,891 | B1 * | 5/2001 | Devens et al. | 206/87 |
| 6,273,358 | B1 * | 8/2001 | Hileman | 242/564.4 |
| 7,654,821 | B2 * | 2/2010 | Vitantonio et al. | 431/131 |
| 7,683,235 | B2 * | 3/2010 | Wendorf | 602/57 |
| 2006/0275726 | A1 * | 12/2006 | Koropsak | 431/253 |
| 2009/0314662 | A1 * | 12/2009 | Åkerlind | 206/86 |
| 2012/0315588 | A1 * | 12/2012 | Kondrat | 431/143 |
| 2013/0138583 | A1 * | 5/2013 | Thuesen et al. | 705/500 |

* cited by examiner

*Primary Examiner* — Jacob K Ackun
(74) *Attorney, Agent, or Firm* — DLA Piper LLP (US)

(57) ABSTRACT

A prior art butane lighter fits into a hole in a hand sized case. The user can flip open a cap on the case and advance a thumbwheel which drives a wax coated hemp wick over the flame of the lighter. The user lights the lighter to ignite the hemp wick, and he then lights any object such as a pipe. The user can reverse the thumbwheel to snuff the hemp wick flame in a chute. A reel of hemp wick is encased in a lower recess of the case. A large lighter case may have a storage container for a pipe, a small lighter case for two and a quarter inch lighters would be minimized in size to eliminate a storage compartment. One embodiment provides a simple thumb advance slot to move the rope forward and backward.

14 Claims, 8 Drawing Sheets

BUTANE LIGHTER AND WICK

CROSS REFERENCE APPLICATIONS

This application is a non-provisional application claiming the benefits of provisional application No. 61/361,153 filed Jul. 2, 2010.

FIELD OF INVENTION

The present invention relates to providing a single case which holds a butane lighter as well as a reel of hemp wick.

BACKGROUND OF THE INVENTION

Known in the art are crude devices which attach to a butane lighter such as a BIC® lighter. These devices slide over the lighter like a sleeve, and the sleeve holds a winding of hemp wick and a built in wick extinguisher. See the I-Tal™ Hempwick Lighter Sleeve distributed by Inity Distributors, Sacramento, Calif. Relevant prior art is the Clipwick™ eBay item no. 140365162893. A clip attaches to a lighter. The clip holds a winding of hemp wick. The uses for these devices include lighting BBQs, fireplaces, lanterns, candles, pilot lights, heaters, cigarettes and pipes. Using the wick to light a pipe prevents a butane taste from contaminating the tobacco. The desired hemp flame also reduces the wasted tobacco used up during lighting. A decrease in butane fuel use is also accomplished. What is needed in the art is a single case sized to contain a disposable butane lighter. The case should contain a reel of hemp wick and a flip top cover to block the wind.

The present invention provides a pocket sized case made of aluminum and/or plastic with a hole for a lighter. The side of the case is removed to install a reel of hemp wick. A thumb wheel advances the hemp wick for lighting. When the thumb reel is reversed, it snuffs the burning hemp wick.

SUMMARY OF THE INVENTION

The main aspect of the present invention is to provide a lighter case that can advance a hemp wick with one hand and allow the lighter to be lit with the same one hand.

Another aspect of the present invention is to provide a flip-up cap that serves both as a wind protector and a scoop.

Another aspect of the present invention is to provide a thumb wheel advancing mechanism that advances the hemp wick over the flame of the lighter and snuffs out the burning hemp wick when retracted.

Another aspect of the present invention is to provide a small storage container in the case.

Another aspect of the present invention is to provide a magnet in the case for mounting to a metal surface.

A handheld device used to ignite, control the movement of, and extinguish, a filament utilizing an embodied heat or flame source, is disclosed.

The present invention allows, for instance, the operator to hold the smoking apparatus in the left hand and the present invention in the right hand, easily ignite the wick with the right hand, place the ignited wick over the matter with the right hand, ignite the matter by drawing breath from the smoking apparatus held in the left hand (or the mouth), and quickly, simply, and safely extinguish the wick after ignition is accomplished by the right hand with no need to shake it.

The present invention is a device that includes:

A container: The container is designed to fit in one hand and be operated exclusively by that hand in a manner easily perfected by the average operator.

An ignition source: The simplest source is a disposable lighter that fits into a slot pre-built into the container. Alternatively, an original lighter or other ignition source could be incorporated into the original device.

A spool/cartridge: A replaceable spool may be pre-wound with the wick (approximately 6'-12' in length, but could be any length, limited only by design) and loaded into a cartridge that fits into the container. The cartridge is placed in the container on the side of the lighter (horizontal spool axis) or underneath the lighter (vertical spool axis), or at any angle in-between, depending on the wishes of a designer.

Different wicks exhibiting different flame characteristics (burn temperature and rate, odor, taste, etc.) may be provided in separate cartridges that all fit the original container.

A door is opened on the container, the cartridge containing the pre-wound wick on a spool is inserted, and with manual twist, the wick is expelled into the guide.

The guide: The guide directs the wick to the "wick controller". The guide may have varying thickness and geometry to accommodate different designs, and accommodates the controlled movement of the wick without tangling.

The wick controller: The wick controller is a component that advances or retreats the wick through the guide with the one hand holding the container. The wick controller can be a "wheel" (embodied in U.S. Pat. No. 6,273,358 B1), incorporated herein by reference, a push button ratchet, or other such device.

Once the wick is advanced to the wick controller, the wick controller is utilized by the operator to further advance the wick through the remaining guide to the exit. The exit is where the wick finally exits the guide. The wick is further extended by the wick controller directly over the flame source.

The flame source is then activated by the operator, and the wick ignited. The flame source is immediately extinguished (for instance, by removing the thumb from a disposable lighter).

A side benefit: If, for example, that flame source is a disposable lighter, it will only remain lit for ¼ to ⅕ the time a lighter would remain lit for the same process, saving on the cost of lighters.

The ignited wick is now placed over the matter to be ignited. The wick chosen burns at the desired rate and intensity. Once the matter is ignited, the operator engages the wick controller with the right hand to retract the wick back onto the exit to extinguish it safely.

The guide may be freestanding or incorporated into a flip-top design that positions the guide properly upon opening the top, or is positioned to extend the wick via the wick controller in a way a designer wishes.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
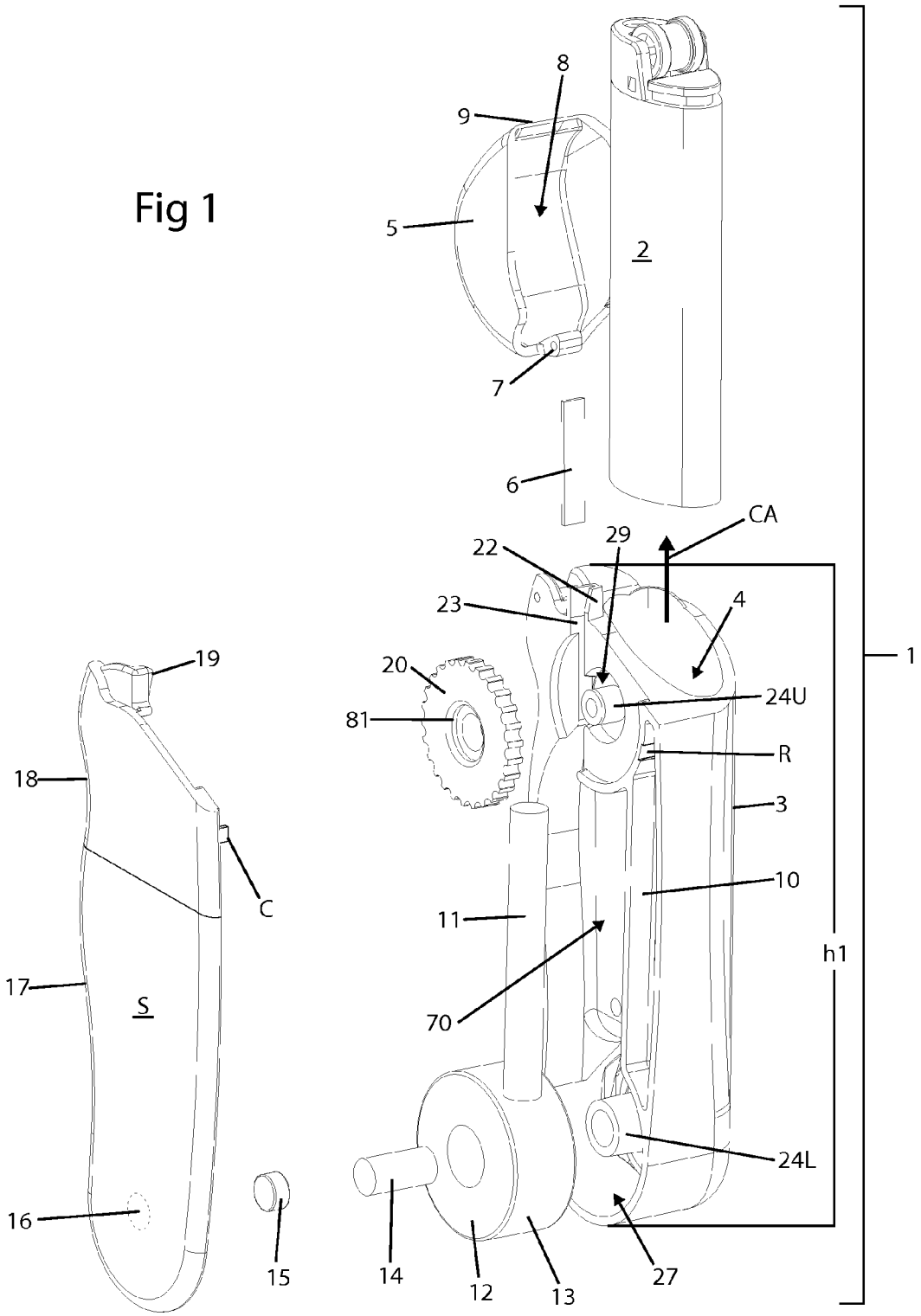
FIG. 1 is an exploded view of the preferred embodiment including a prior art butane lighter.

Referring first to FIG. 1 a lighter and wick holder 1 has a main body 3 with a hole 4 sized to hold a lighter 2. A flip-up cap 5 has a hinge 7 and is biased closed by a spring 6. The cap 5 has a cavity 8 that be used as a scoop via lip 9. A storage compartment 10 may hold a pipe 11.

A boss 24L holds a magnetic axle 14 which mounts the spool 12 in the lower recess 27 of main body 3. A coupling magnet 15 is mounted in the cavity 16 of door 17 to irremovably mount the door 17 to the main body 3. The magnet 14 is preferably a strong rare earth magnet which can hold the wick holder 1 against a metal surface on door surface S.

Figure 5:
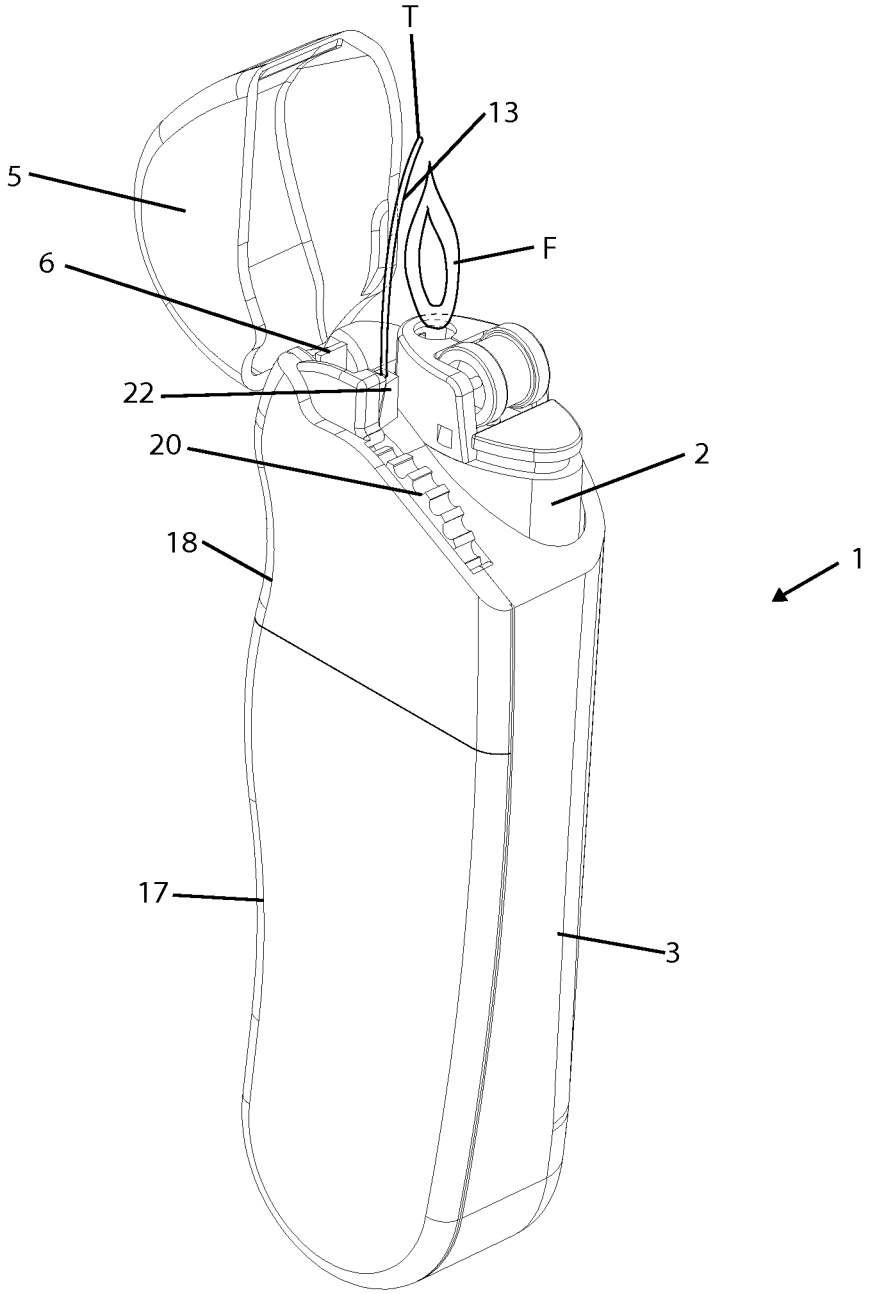
FIG. 5 is a front perspective view of the invention shown in FIG. 1 in use lighting the hemp wick.

The upper door cover 18 should not be removed by its clips C from recesses R because the thumbwheel 20 will fall out of the upper recess 29. Upper post 24U secures the thumbwheel in upper recess 29. The upper door cover 18 has a bias ramp 19 which diverts the hemp wick 13 out over a flame of the lighter 2 as seen in FIG. 5. The rope guide 70 is an open space.

Figure 7:
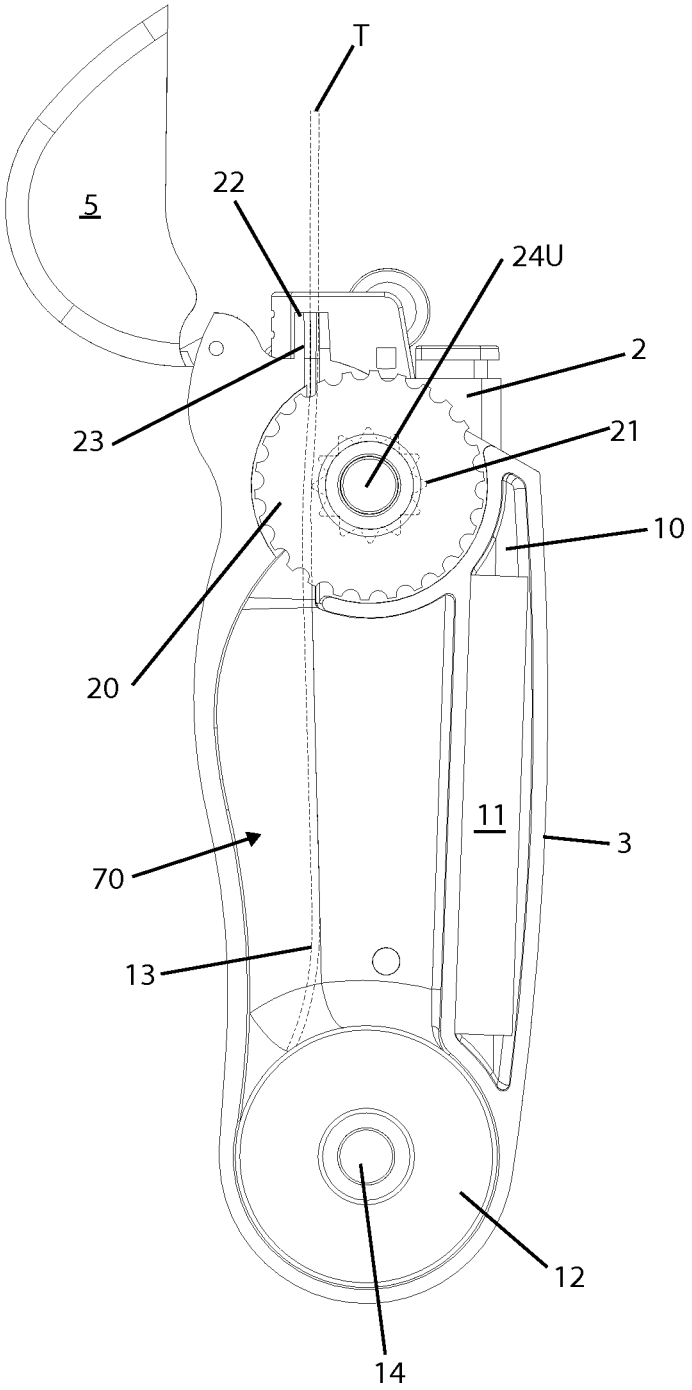
FIG. 7 is a side elevation view of the invention shown in FIG. 1 with the side door removed showing the travel of the hemp wick.

The thumbwheel 20 has a driving gear 21 seen in FIG. 7. The driving gear 21 engages the hemp wick 13 and drives it out chute 22. Chute 22 has a narrow throat 23 which snuffs out the hemp wick flame when the thumbwheel 20 is reversed to drive the tip T into the narrow throat 23. The narrow throat 23 extends next to the driving gear 21 to allow the driving gear 21 to pinch and propel the hemp wick up the chute 22.

Figure 2:
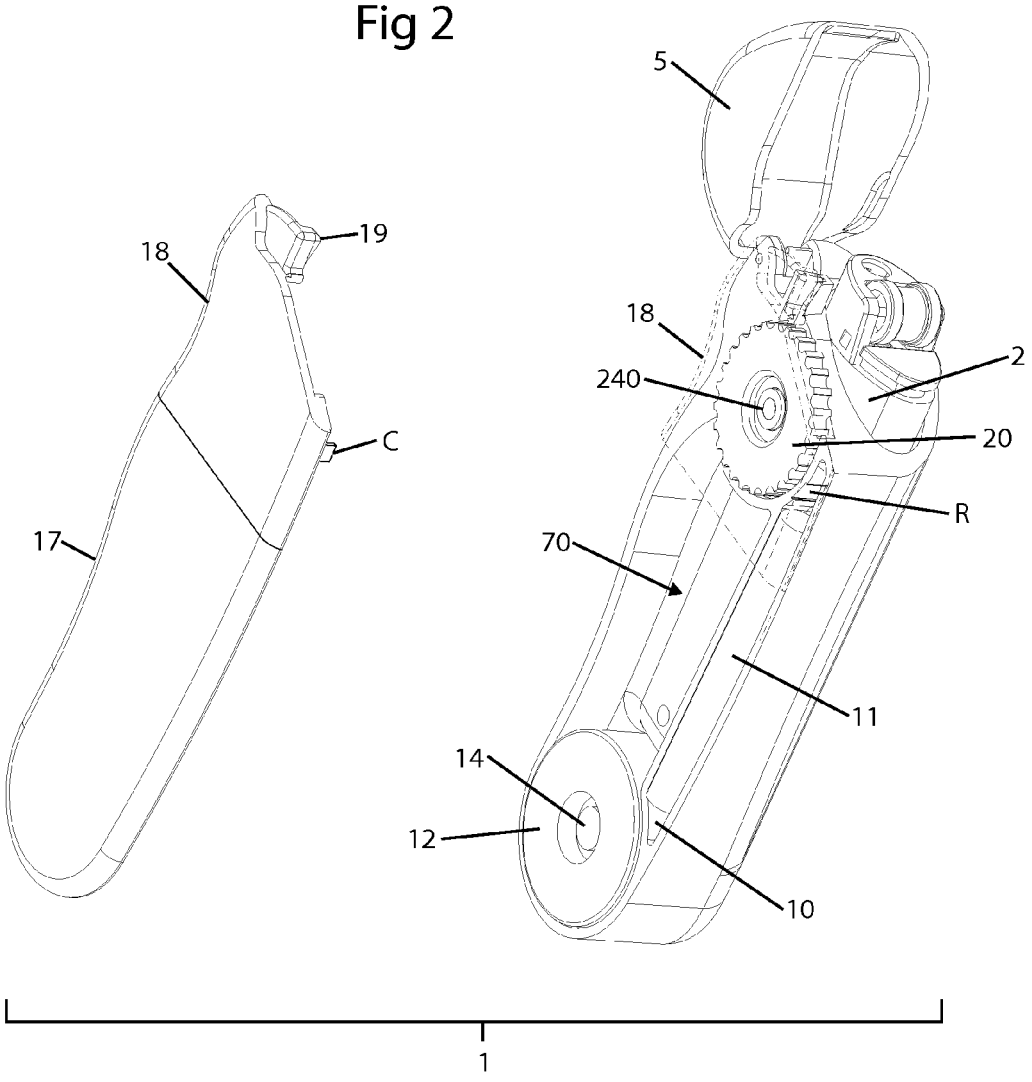
FIG. 2 is a side perspective view of the invention shown in FIG. 1 assembled with the side door removed.

Referring next to FIG. 2 the door 17 is removed to allow a reel 12 to be replaced.

Figure 3:
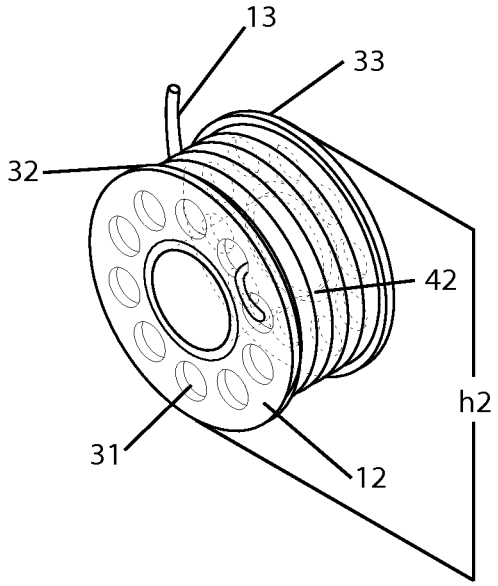
FIG. 3 is a side perspective view of a two sided reel.
Figure 4:
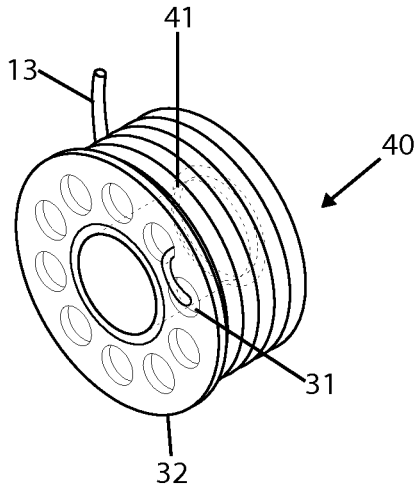
FIG. 4 is a side perspective view of a one sided reel.

Referring next to FIGS. 3, 4 two embodiments of a waxed hemp wick reel are shown. The reel 12 has two retaining walls 32, 33 joined by a column 42. The holes 31 allow the hemp wick 13 to be anchored before being reeled around column 42. Up to about ten feet of waxed hemp wick, one sixteenth inch diameter can be wound around either reel 12 or 40, nominal dimensions are h2=1", h1=4.5".

Figure 6:
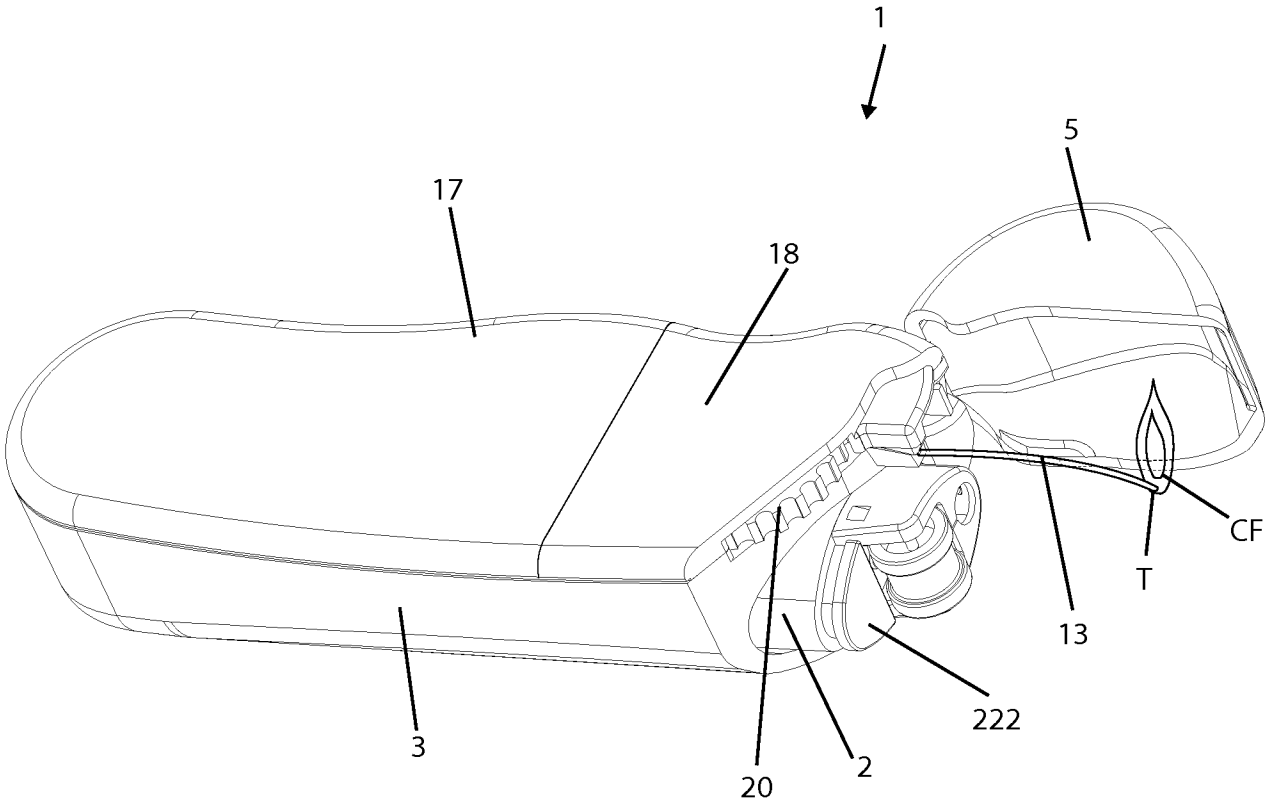
FIG. 6 is a front perspective view of the invention shown in FIG. 1 held sideways using the desired hemp wick flame for ignition.

Referring next to FIG. 5 the tip T of hemp wick 13 has been biased over flame F of lighter 2. In FIG. 6 the flame F has been extinguished by relieving pressure from valve flapper 222 to shut off the butane in a known manner. With one and the same hand the user is ready to use the desired flame CF of hemp wick 13 for ignition.

Figure 8:
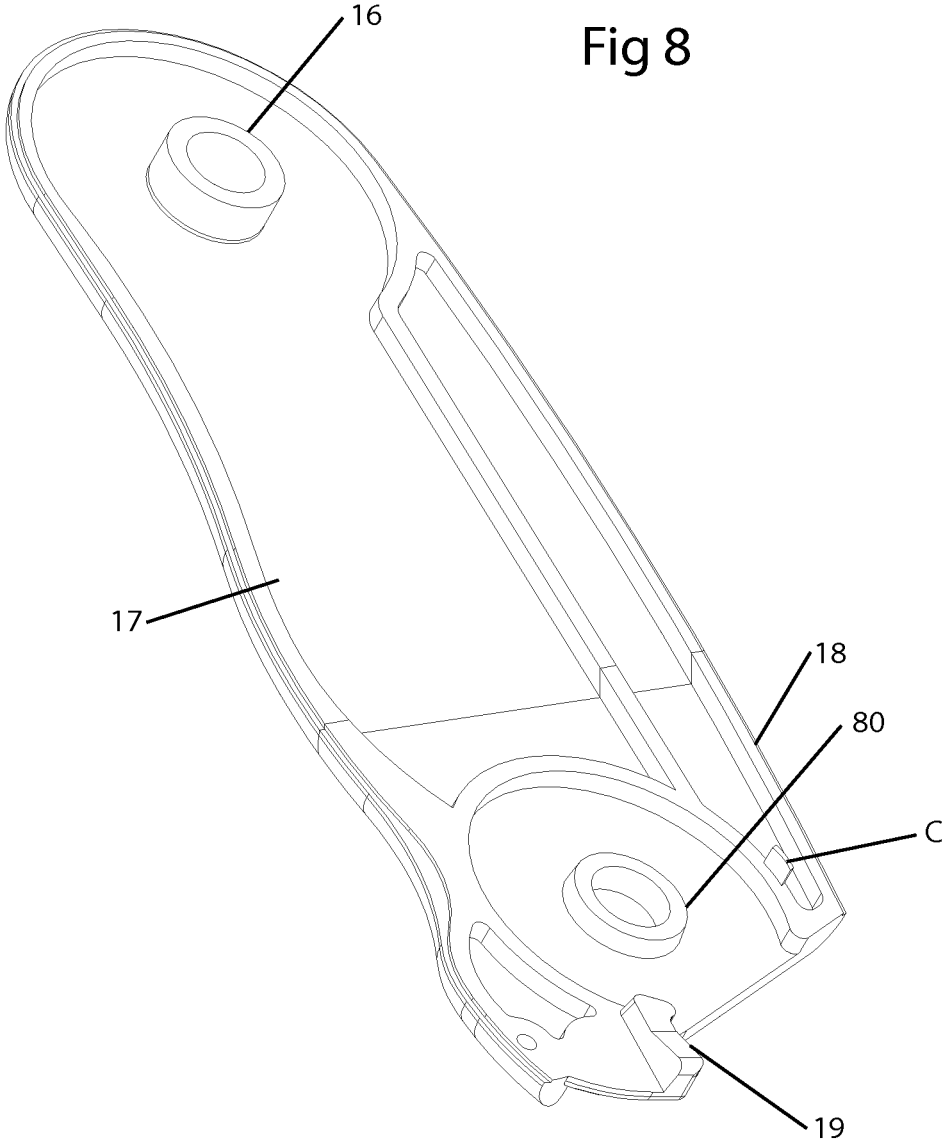
FIG. 8 is a side perspective view of the side door.

Referring next to FIG. 8 the upper door cover 18 has a rim 80 that secures into recess 81 of thumbwheel 20 as seen in FIG. 1. The ramp bias 19 is seen to bias the tip T of hemp wick 13 over flame F in FIG. 5, which is toward the central axis CA of the hole 4 as seen in FIG. 1. Not shown is an equivalent to the thumbwheel which is a finger operated cam to advance a rope through a channel. The cam may be spring biased to a ready position. Other equivalents include a small motor drive assembly.

Figure 9:
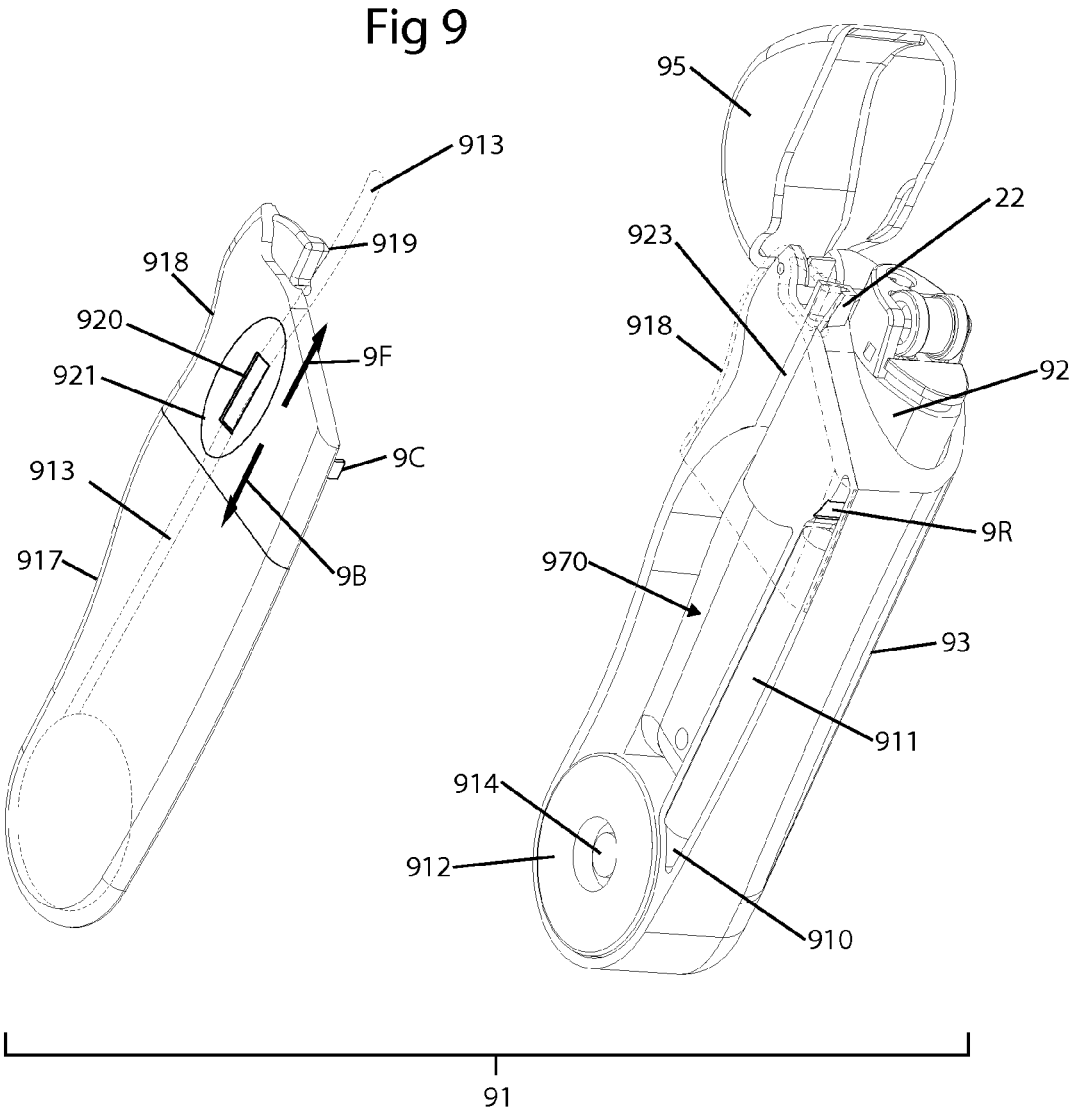
FIG. 9 is a partially exploded view of a thumb advance embodiment.

Referring next to FIG. 9 a holder 91 functions the same as holder 1 of FIG. 1, however, the thumbwheel 20 is no longer needed. The upper case 918 can be attached to the main body 93 with a clip 9C and recess 9R. The rope chute 923 supports the rope 913 to enable a user's thumb (not shown) to advance 9F and retract 9B the rope 913 in the rope chute 923 by simple wedging the rope 913 in the rope chute 923 and then moving the rope 913 in the desired direction. The slot 920 provides access by the thumb to the rope 913. An optional pop out slot fixture 921 may be used. A ramp bias 919 helps urge the rope toward the lighter. The lower case 917 is removable to replace the reel 912. The axle 914 may be a magnet. An optional storage area 910 may hold a pipe 911. Rope guide 970 enables the rope 913 when retracted to bundle up in an open space. A cap 95 is optional. A standard lighter 92 is shown.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. An apparatus comprising:

(a) a reel of wick;

(b) a main body having a hole sized to retain a lighter, the main body comprising (i) a lower recess housing the reel of wick;

(ii) a chute adjacent a top of the hole; and (iii) a slot disposed adjacent the chute, wherein the slot provides access to wick disposed in the chute such that the wick is advanced and retracted within the chute by direct contact with a user's finger.

2. The apparatus of claim 1, wherein the main body has an access enabling replacement of the reel.

3. The apparatus of claim 2, wherein the main body further comprises a channel from the lower recess to the chute through which wick is advanced or retracted.

4. The apparatus of claim 3, wherein the chute directs the wick external to the main body.

5. The case of claim 1, further comprising a cap.

6. The case of claim 1, further comprising a magnetic axle for securing the reel.

7. The case of claim 4, wherein the chute further comprises a narrow throat functioning to extinguish a flame of the wick when the wick is retracted into the chute.

8. The apparatus of claim 1, further comprising a lighter disposed within the hole.

9. A holder for a lighter and a reel of wick, the holder comprising:

(a) a main body having (i) a recess for housing a lighter, wherein the recess has a top and a central axis; (ii) a reel mount; and (iii) a chute adjacent the top; and (b) a wick advancement assembly adjacent the recess, wherein the wick advancement assembly is a slot disposed adjacent the chute, wherein the slot provides access to wick disposed in the chute such that the wick is advanced and retracted within the chute by direct contact with a user's finger.

10. The holder of claim 9, wherein the wick advancement assembly directs the wick external to the main body.

11. The holder of claim 10, wherein the wick advancement assembly further comprises a flame snuffer.

12. The holder of claim 11, wherein the main body further comprises a reel of wick disposed on the reel mount.

13. A flame producing hand held case, said case comprising:

(a) a reel of wick, and a wick advancement assembly;

(b) a flame generator; and (c) a main body housing the flame generator, wherein the wick advancement assembly has a channel operable to direct the wick over a flame generated by the flame generator, and wherein the wick advancement assembly is a slot disposed adjacent the channel, wherein the slot provides access to wick disposed in the channel such that the wick is advanced and retracted within the channel by direct contact with a user's finger.

14. The case of claim 13, wherein retraction of the wick within the channel snuffs a flame of the wick.

* * * * *